United States Patent [19]

St. Clair

[11] 3,933,195

[45] Jan. 20, 1976

[54] LIQUID-LIQUID HEAT EXCHANGER MADE OF PLASTIC SHEETS IMBEDDED IN MASS OF PEBBLES

[76] Inventor: John C. St. Clair, Box 216, R.R. 5, London, Ohio 43140

[22] Filed: Mar. 13, 1972

[21] Appl. No.: 234,136

[52] U.S. Cl. ..... 165/1; 165/DIG. 8; 165/165

[51] Int. Cl.[2] ..... F28F 3/00; F28F 21/06

[58] Field of Search ..... 165/1, 166, 104, 165

[56] References Cited

UNITED STATES PATENTS

| | | | |
|---|---|---|---|
| 3,075,580 | 1/1963 | Davis, Jr. | 165/104 |
| 3,216,492 | 11/1965 | Weaver | 165/166 |
| 3,705,618 | 12/1972 | Jouet et al. | 165/166 |

*Primary Examiner*—Albert W. Davis, Jr.

[57] ABSTRACT

A high efficiency liquid-liquid heat exchanger is made by imbedding 1 mill polyester plastic film in a mass of quartz pebbles. The quartz pebbles are 0.125 to 0.25 inches in diameter and are placed in 0.25 to 0.5 inches thick layers between the plastic sheets. The two liquids flow on alternate sides of the sheets and the flows of the liquids are given a 90° angular spiral flow in relation to each other by strips of plastic cemented between the sheets. In this way a stream tube, or small division of the main flow of one of the liquids, is heated by short elements of a large number of stream tubes of the other liquid and the effects of uneven placement of the pebbles and the resulting channeling of the liquids are overcome. Heat transfer coefficients as high as several hundred BTU's per degree Fahrenheit per hour per square foot of plastic surface have been easily obtained with very low pressure drops. The plastic sheets and quartz pebbles are very cheap and the heat exchanger is easily assembled. The heat exchanger can be operated, if desired, at relatively high flow rates and pressure drops, and higher heat transfer rates obtained.

27 Claims, 6 Drawing Figures

LIQUID-LIQUID HEAT EXCHANGER MADE OF PLASTIC SHEETS IMBEDDED IN MASS OF PEBBLES

Figure 1:
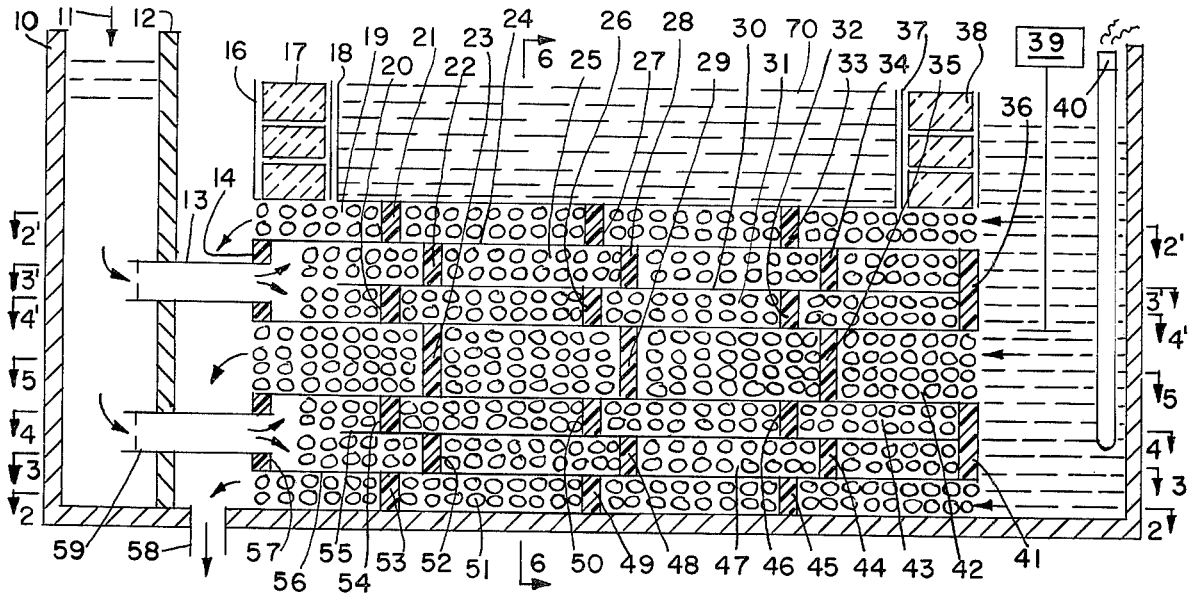

Many very important processes would be greatly cheapened if there was a cheaper method for heating cold liquids by means of hot liquids. For example it would be highly desirable to sterilize the effluent water from sewage plants by heating it. However it would be necessary that a highly efficient but very cheap liquid-liquid heat exchanger be provided that would heat up the cold germ-filled sewage effluent water, by means of the hot sewage water that had been sterilized by heating it to at least 200° Fahrenheit. Also in the production of methane (synthetic natural gas) a cheap liquid-liquid heat exchanger would greatly cheapen all existing processes. It is necessary to remove the gaseous sulfur compounds and the carbon dioxide from the gasified coal. Also it would be very desirable to just partially convert the purified gas, from coal, to methane and then remove the methane as product and recycle the gas from which the methane had been removed. In all of these steps it is possible to use suitable cold solvents to separately absorb the various compounds mentioned. However each solvent would have to be separately heated to a temperature at least 100° Fahrenheit hotter in order to boil off the absorbed compound. The difficulty is that in the preferred cases the solvents that must be used are not good solvents and relatively large amounts of the solvents must be used. This necessary heating of the solvents formerly has required very expensive amounts of heat and equipment since the heat exchangers available have been expensive and not very efficient. It is the object of this invention to provide very cheap and relatively efficient heat exchangers to provide cheap means for carrying out the above operations besides many others that will be obvious to chemical engineers.

The extreme cheapness of plastic films, if they could only be used for heat exchangers, has long been appreciated by others. The reader is referred to an article entitled "Plastic Film Heat Exchangers" by J. M. Weaver in the magazine *Chemical Engineering Progress*, Vol. 56, page 49 et seq. (1960). The fact was emphasized that at least in theory plastic films like 0.002 inch thick polyester film can be substituted for expensive metal tubing like Monel tubing which costs 340 times as much per square foot. However it is also emphasized that the plastic film is so much weaker than metal that it was impractical at that time to use plastic film with any appreciable pressure differential across the film. In summarizing the work up to that time Weaver just concluded that, while the use of plastic films in heat exchangers offered interesting possibilities, there was nothing that had been developed that was very practical in the field.

Since Weaver's article I have invented the method of imbedding plastic films in masses of pebbles which act as supports for the plastic films and allow high pressure differentials across the plastic films. This allows the use of very thin films to be used with very high heat transfer properties. This was specifically used in my patent entitled MULTIPLE-STAGE EVAPORATOR, Ser. No. 91,511, now U.S. Pat. No. 3,654,092, which has been granted but not yet published.

It may be thought that by just imbedding parallel plastic films in a mass of pebbles and that by passing parallel flows of two liquids in opposite directions on opposite sides of the films that a satisfactory heat exchanger may be obtained. However this was found not to be the case. After considerable work it was found that in this method of construction it was necessary to place the plastic films at extremely precise distances apart or the liquid flow on one side of a long narrow section of the film would not equal the flow of liquid on the other side of the film and heat and material balances showed that it was impossible for efficient heat transfer to occur. This effect is quite similar to the loss of efficiency in distillation and gas absorption packed columns when the phenomenum called "channeling" occurs.

It was found that the needed extreme precise fabrication of a pebble supported heat exchanger was completely impractical where the flow of the two liquids was parallel through in opposite directions. However it was found that, by having the directions of flow of the two liquids at an angle with each other, this necessity for extreme precise fabrication was overcome. In considering this it is convenient to use the term "stream tube" as defined by Dodge and Thomson in their book *Fluid Mechanics*, McGraw-Hill Book Co., New York, 1937, pages 74–76. In this book, a flow of a stream of fluid is considered in the imagination as divided up into a very large number of very small parallel streams of fluid, the flow in the length of a stream tube being constant. In parallel flow of the two liquids on opposite sides of the plastic film it is necessary for the flows of the two stream tubes on the opposite sides of the plastic film to be nearly equal. Or from mathematical calculations if you need N transfer units to conduct the heat transfer you desire in a heat exchanger your heat exchanger will require excessive surface per transfer unit if there is more difference between the stream tubes on the opposite sides of the plastic film than ½N times the size of the smaller stream tube. In the common case of liquid-liquid heat transfer where the same liquid is being cooled that was heated by the heat exchanger, (N+1)= the total temperature, that the cooler liquid is heated, divided by the temperature difference, between the two liquid streams at a point in the heat exchanger. Since in many liquid-liquid heat exchanges it is desired to recover all most all the heat or N is desired to be greater than 10 or even 100 it can be seen that the relative difference allowable between the stream tubes can be extremely small.

However if the directions of the two liquids on opposite sides of the plastic film are at an angle a given stream tube crosses and receives heat from a very large number of short lengths of different stream tubes on the opposite side of the film. This effect is true for all the stream tubes on both sides of the plastic film. From a theoretical standpoint this procedure has great advantages for heat transfer through films imbedded in a mass of pebbles. In placing the film between the pebbles you will obviously make some layers of pebbles between the films at places too thick and at other places too thin and as a result the flow in some stream tubes will be too big and the flow in others will be too small. But from the laws of probability the average of a large number of stream tubes will be nearly correct as desired. And since you are now dealing with a stream of liquid from a large number of combined stream tubes it is now possible to put orifices in the inlets for these large combined streams to correct any error in overall equality of flow.

It has been further found that by using crystalline nonmetallic pebbles, for supporting and imbedding the plastic films in, that the rate of heat transfer of the heat exchanger can be roughly doubled. This is because crystalline pebbles, instead of blocking the transfer of heat to and from the plastic film as ordinary pebbles do, actually act as fins that assist in the heat transfer to and from the plastic film.

The special behavior of crystalline materials is well summarized by Jakob in his book *Heat Transfer*, Vol. I, published in 1949 by John Wiley & Sons, New York, page 95. Jakob writes as follows.

"Comparison of heat conduction by the so-called amorphous or glassy and the crystalline substances is of particular interest because of their entirely opposite behavior. As Euken (1911) seems to have stated first, the thermal conductivity of amorphous bodies is small at low temperature and increases with increasing temperature, whereas that of crystals is high and decreases with increasing temperature."

Examples of the thermal conductivity in the temperature range of 32° Fahrenheit to 212° Fahrenheit have been abstracted from Jakob's book, just cited, pages 95–98, from *Heat Transmission* by McAdams, 2nd. Ed., 1942, McGraw-Hill Book Co., New York, pages 382–384, and from *Perry's Chemical Engineers' Handbook by Perry, Chilton and Kirkpatrick, McGraw-Hill, New York, Fourth Edition*, 1963, page 23-59.

Refractories Company of Cleveland, Ohio. The deposit is in Eastern Pennsylvania near Womelsdorf. A 700 pound run-of-mine sample was sieved and over 40% of the sample was in the preferred ⅛ inch to ¼ inch fraction.

I prefer to limit the use of crystalline materials, for the use in pebbles, to those materials that are nonmetallic. This is because metals are much more expensive and are subject to corrosion. I define nonmetallic materials in this patent as materials that do not add oxygen and form an alkaline substance.

FIG. 1 shows an elevation view of one form of my heat exchanger.

Figure 2:
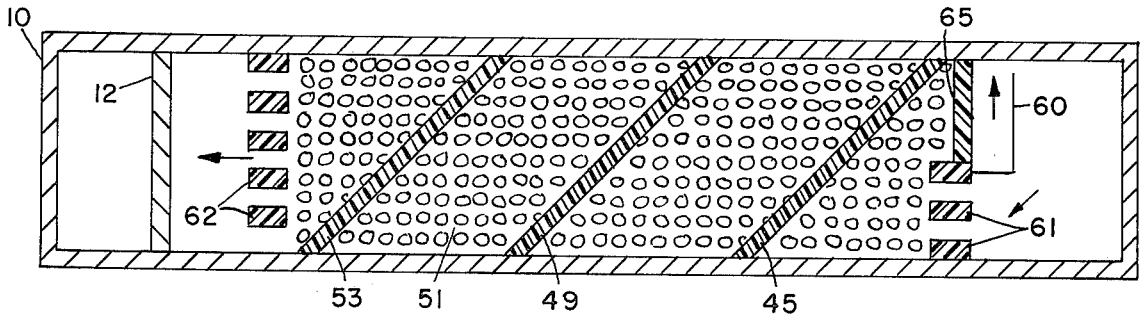

FIG. 2 shows a plan view of my heat exchanger at the elevation 2—2 of FIG. 1. FIG. 2 also may be used to show the plan view at the elevation 2'–2' of FIG. 1 by merely changing the numbers. The numbers 53, 51, 49, and 45 are changed to 21, 19, 27, and 33, respectively and the numbers of parts 62, 61 and 65 are omitted.

Figure 3:
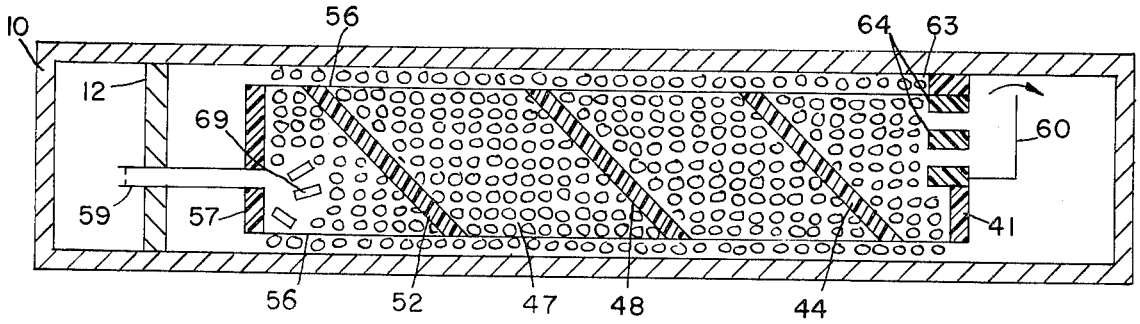

FIG. 3 shows a plan view of my heat exchanger at the elevation 3—3 of FIG. 1. FIG. 3 may also be used to show the plan view at the elevation 3'–3' of FIG. 1 by merely changing the numbers. The numbers 59, 57, 56, 52, 47, 48, and 44 are changed to 13, 14, 24, 22, 25, 28, and 34, respectively and the numbers of parts 69, 41, 63, and 64 are omitted.

Figure 4:
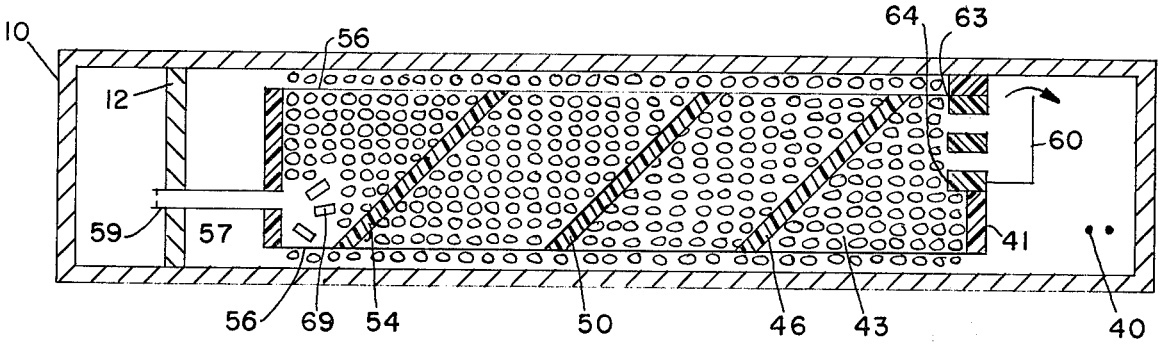

FIG. 4 shows a plan view of my heat exchanger at the elevation of 4—4 on FIG. 1. FIG. 4 may also be used to show the plan view at elevation 4'–4' of FIG. 1 by merely changing numbers. The numbers 59, 57, 56, 54, 50, 46, and 43 are changed to the numbers 13, 14, 24, 20, 26, 32, and 31 respectively. Numbers 69, 41, 63, and 64 are omitted.

Figure 5:
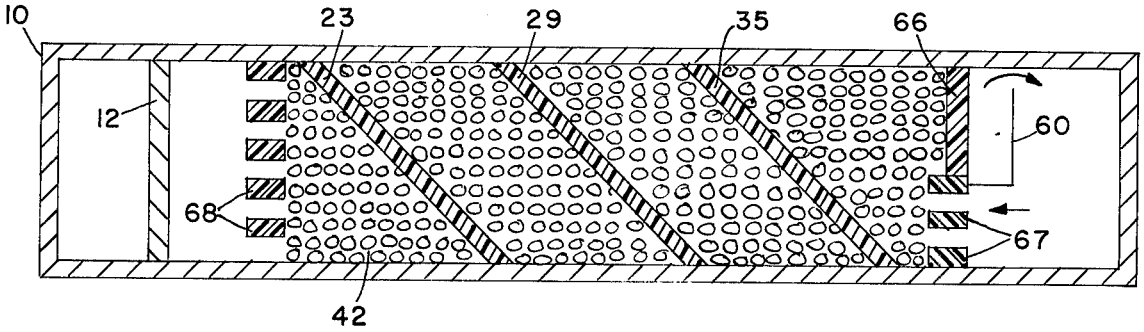

FIG. 5 shows a plan view at elevation 5—5 on FIG. 1.

I. Noncrystalline Materials

| | Thermal Conductivity |
|---|---|
| Asphalt | 0.43 Btu/(hr)(sq.ft.)(deg.F. per ft.) |
| Glass | 0.2–0.73 " |
| Lava | 0.49 " |
| Granite (Probably containing some crystals) | 1.0–2.3 " |
| Limestone | 0.54 " |
| Slate | 0.86 " |
| Fused Quartz that was rapidly chilled after fusion | 1.2 " |

II. Nonmetallic Crystalline Materials

| | Thermal Conductivity |
|---|---|
| Mullite ($3Al_2O_3.2SiO_2$) | 3.2 Btu/(hr)(sq.ft.)(deg.F per ft.) |
| Corundum ($Al_2O_3$) | 5.5 " |
| Periclase (MgO) | 21.0 " |
| Carborundum (SiC) | 37.0 " |
| Graphite (30% Voids) | 75 " |
| *Anthracite carbon (21% Voids) | 8.7 " |
| *Petroleum Coke (% Voids not given) | 3.4 " |
| Quartz Crystals ($SiO_2$) | 6.5 average " |

*Carbon formed by heating a carbon containing material, which is the process known as coking, gives carbon in a crystalline form but the crystals are much smaller than the crystals known as graphite. Graphitization is merely a process in which by heating the size of such crystals are made to grow. See Chemistry of Coal Utilization by Lowry, Editor, John Wiley & Sons, New York, 1945, Vol. I, pages 904–905. The thermal conductivity of graphite, and carbon formed by heating, (that is coke), is greatly affected by the percentage of voids, the thermal conductivity varying roughly as the third power of the volume percentage of the solid material present per unit volume of pebble. Obtaining carbon or graphite by calcining anthracite, which has a low percentage of volatile matter to lose when heated, is the preferred method for obtaining carbon and graphite since it gives pebbles with a low fraction of voids. Graphite is carbon calcined at temperatures usually over 2000° Centigrade and sometimes over 3000° Centigrade. Graphite has a greasy nature and anthracite graphite is especially greasy. It is preferred over carbon where there is considerable pressure exerted across the plastic sheets since it does not have sharp edges that may pierce the plastic sheets. Since carbon is hard it is best used with low pressure differentials exerted across the plastic sheets.

Figure 6:
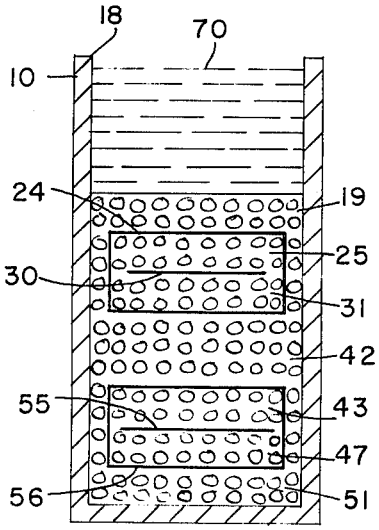

The preferred material for pebbles in my heat exchanger is quartz crystals. These are particularly attractive since there are big deposits where rivers have tumbled quartz crystals until the sharp corners have been rubbed off. A particularly large and convenient deposit of such quartz pebbles is owned by the North American FIG. 6 shows an elevation of my heat exchanger at 6—6 perpendicular to FIG. 1.

Referring to the drawings and particularly to FIG. 1 there is an outer rectangular vessel or case at 10. Liquid is shown entering at 11. The liquid then passes through manifold plate 12 by orifice-controlled pipes 13 and 59. Taking the lower orifice-controlled pipe 59 we find as shown in FIGS. 3 and 4 that the liquid passes on through distributor or rather supports 69 and then as shown on FIGS. 1 and 6 divides into two streams to flow on both sides of plastic sheet 55. The lower stream flows through pebbles 47 as shown on FIG. 6 and FIG. 1. The upper stream flows through pebbles 43 as shown in FIG. 6 and FIG. 1. Plastic barriers 52, 48 and 44 on FIGS. 3 and 1, and plastic barriers 54, 50 and 46 in FIGS. 4 and 1 give the two streams of liquid that have entered by 59 a counter-clock like spiral motion, within plastic sheet 56, around plastic sheet 55 in FIG. 6.

As shown in FIGS. 3 and 4 the liquid streams just mentioned flow out between the supports 64 and pass around vertical baffle 60 as shown in FIG. 3 and FIG. 4. Then the liquid is heated by electric heater 40 in the present example. The liquid is then mixed by rotary mixer 39 and passes back through the heat exchanger.

As shown in FIG. 1 and FIG. 2 half of the above liquid stream passes through suports 61 into the bottom layer of the heat exchanger. As shown in FIGS. 1 and 5 the other half of the liquid above mentioned flows back through the heat exchanger at the level shown by FIG. 5 through supports 67. Here again the liquid is given a spiral motion though this time in a clock-wise manner when viewed in the direction of flow. That is by plastic barriers 45, 49, and 53 as shown in FIG. 2 and FIG. 1 and by plastic barriers 35, 29, and 23 as shown in FIG. 5 and FIG. 1 the liquid in the bottom portion of pebbles 42 in FIG. 6 and the liquid in the pebbles shown as 51 in FIG. 6 rotate in a clock-wise spiral manner around plastic sheet 56. These liquids just mentioned pass out of the heat exchanger through supports 62 in FIG. 2 and supports 68 in FIG. 5 and then together through bottom outlet 58 in FIG. 1.

The flow of liquid through-orifice controlled pipe 13, in FIG. 1, through the jacket of plastic film 24, in FIG. 6, and that is rotated around plastic film 30, in FIG. 6, by plastic barriers 22, 28, 34, 20, 26, and 32 is identical as previously described for the liquid entering by orifice-controlled pipe 59, though the liquid is rotated in a clock-wise spiral in pebbles 25 and 31. This flow initially through orifice-controlled tube 13 and then through the plastic jacket 24 in FIG. 6 passes out by vertical baffle 60 and then is heated by electric heater 40 and mixed by mixer 39. It then splits into two streams that pass back in pebbles 19 and 42 on both sides of the jacket 24, as shown in FIG. 6, and is given a counter-clock wise spiral rotation, as viewed in the direction of flow, by plastic barriers 33, 27, 21, 35, 29, and 23 through pebbles 19 and 42. The two streams pass on out through the pebbles in the open space to the right of manifold plate 12 and then the streams pass out of the apparatus by bottom outlet 58.

It should be stressed that the apparatus was surprizingly easy to fabricate. Or at least good results were obtained from my heat exchanger when there was no special effort to keep the layers of gravel exactly equal in depth. I would just line them up with my eye and did not use a straight edge to level up the gravel layers. The plastic barriers mentioned were made out of polyurethane foam strips ¾ inches wide and ¼ inches thick with adhesive on both sides. This material is manufactured by Minnesota, Mining & Manufacturing Co., St Paul, Minn. The material comes in rolls like ordinary pressure sensitive adhesive tape with the two-faced tape being prevented from having its top face sticking on everything too soon by a strip of paper. You apply the double-faced tape like ordinary pressure sensitive tape with adhesive on one side. Then your remove the strip of paper from its top face. This latter operation is done after you put the surrounding layer of pebbles in place. That is when you put a layer in place, as for example anyone of the layers shown in FIGS. 2, 3, 4, and 5, you first put down the two-faced tape with the top face protected by its strip of paper. Then you sprinkle in enough pebbles to roughly fill up to the level of the tops of the tape. Then you remove the paper strips on the tops of the tape and you are ready to put down the plastic sheet for the bottom of the next higher layer.

For the layer of pebbles in FIG. 5 that is twice as thick as the other layers, two layers of the ¼ inch thick two-faced pressure sensitive plastic tape was used. For the longitudinal seals of the plastic heat transfer surfaces 24 and 56, in FIG. 6, two faced adhesive tape ¾ inch wide and of very thin thickness was purchased from Sears Roebuck under their label and was used. The seals around the orifce-controlled pipes 59 and 13 were made by making metal molds out of thin sheet metal and inserting the pipes in the molds and filling up the open parts of the molds around the pipes with epoxy plastic putty brought from Sears Roebuck. This putty set to a very hard material bonding strongly to the metal molds and the pipes.

It is very desirable that the top of the top layer of pebbles 19 be held down with an even pressure. This is very conveniently done by having a sheet of plastic film 18 lain on top of the top layer of pebbles 19 which film is held up at the sides by the outer container 10, as shown in FIG. 6, and is held up at the ends by bricks 17 and 38 wrapped in plastic films 16 and 37 respectively. Plastic film 18 in this manner makes a container in which water 70 as shown in shown in FIG. 6 is placed that holds down the internal liquid pressure within the apparatus.

The plastic two-faced pressure sensitive adhesive tapes used are described as lasting indefinitely and can be used in permanent installations. However, if desired the longitudinal seals may be made by heat or sonic sealing of the plastic sheets 24 and 56 in the conventional manner. Instead of two-faced thick plastic foam tape for the plastic barriers there may be used bands of fine sand through which the liquid flows only slowly. In this way acids may be used to remove gypsum and calcium carbonate scales though it is believed that by just using 2 inch wide foam tapes the adhesive on the tapes will last long enough to give seals through a practical life of the apparatus. Also the normal pressure down on the springy foam tape will very probably give enough seal to give the desired spiral motion to the liquid flows through the apparatus.

It is admitted that it will be rarely practical to take my heat exchanger apart and clean it mechanically. However the two common types of scale that cause fouling of heat exchangers can easily be removed by hot concentrated hydrochloric acid. The hydrochloric acid reacts directly with any calcium carbonate scale and the hot concentrated acid will dissolve gypsum. The gypsum will precipitate out of the hot acid when the hot acid is cooled and the acid can be used over again. The cellulose in biological fouling and sewage solids can be removed by very concentrated hydrochloric acid also. Cleaning with hot concentrated hydrochloric acid is rarely practical with prior heat exchangers. The fats and oils can be removed by organic solvents. Silica and most clays can be removed easily by hydrofluoric acid if graphite or carbon pebbles are used. Crystalline calcium fluoride pebbles are an alternative also in this case. Therefore my heat exchanger in about all cases will be cheaper to keep clean than conventional metal heat exchangers. However since my heat exchanger is so cheap a large excess of area can be used and the heat exchanger can be allowed to foul up.

The types of plastic film preferred for a given heat exchanger will of course depend on the liquids and temperatures encountered. For example with water up to 140° Fahrenheit one mill thick polyester is normally preferred. For higher temperatures with water polypropylene film one mill thick is preferred. It is claimed that the newer varieties of polyethylene film will be satisfactory at quite high temperatures. Also poly(vinylfluoride) is good at temperatures nearly to the boiling point of water. The highly fluorinated plastics are are expensive but are quite advantageous for high temperatures with corrosive liquids. Silcone rubber films can stand water and many other liquids at temperatures of at least 450° Fahrenheit. For liquids that do not contain water polyester film can be used to temperatures over 220° Fahrenheit.

The number of plastic films that can be used is large when considering heat exchangers that handle liquids at temperatures below the freezing point of water. Usually one mill thick polyester film is preferred.

In this patent the term "plastic" is defined as any material made by joining together or polymerizing together at least 10 molecules of a single organic compound into one larger molecule.

In this patent the term "organic compound" is defined as a compound having a molecule in which there is at least one hydrogen atom or halogen atom attached directly to a carbon atom.

In this patent the term "pebble" is defined as a piece of solid material whose maximum diameter is less than 6 inches. While smaller pebbles are preferred pebbles up to this diameter can give superior results than conventional heat exchangers. Pebbles are preferably but not necessarily free of voids.

The plastic films or sheets are preferably but not necessarily thin. That is of a thickness of less than 0.005 inch. Normally films as thin as 0.001 inch or 1 mill can be used and provide heat exchangers with high rates of heat transfer. But films may be as thick as 0.1 inch and still in some cases give superior results to conventional equipment. Therefore I define my sheets or films of plastic as being less than 0.1 inch thick.

EXPERIMENTAL

A 50 square foot heat exchanger was built and used to heat cold water at 58° Fahrenheit up to 113° Fahrenheit by water at 116.5° Fahrenheit. The heat exchanger was 65 inches long and 14 inches wide. There were 8 horizontal heat transfer surfaces. That is two units like that shown in FIG. 1 of the drawing were built one unit over the other unit. The angle of the plastic baffles was 45° like that shown in the drawing. Quartz pebbles 0.125 to 0.25 inches in diameter were used in 0.25 inch thick layers except for the two layers, like FIG. 5 in the drawing, that were 0.5 inches thick. The rate of liquid flow was calculated from the heat balance at the hot end and was about 1000 pounds of water per hour apiece for both streams of water. Therefore a heat transfer coefficient of over 250 Btu(hr)(sq.ft.)(deg.F.) of heat transfer surface was obtained. In actual operation this should be considerably increased since the flow rate should be easily doubled and the heat transfer rate of this heat exchanger, like other heat exchangers, is proportional to some power of the flow rate. The pressure drop through the heat exchanger from right to left in FIG. 1 in the experimental model was of the order of 0.25 inches of water as expected. However the supports 69, in FIGS. 3 and 4, were left out and a bottle neck to flow there was observed. That is the overall pressure drop of the liquid from left to right in FIG. 1 was 3 inches of water pressure drop instead of the 0.25 inches of water pressure drop as calculated for liquid flow through beds of pebbles and as actually measured for the return flow from right to left in FIG. 1. This was checked by the fact that the excess pressure did not occur far into the bed of pebbles from the left since the film holding the water 70 did not rise. The orifices in the inlet pipes 59 and 13 were not used though it is possible that such use might have raised the rate of heat transfer.

It was also found that the heat exchanger did not take as much water to fill as calculated and it is believed that venting was not complete. The only venting used in the example built was due to a slow flow of water pushing the air out and the sloping of the heat exchanger about 1.25 inches upward towards the end of the heater. It is highly recommended that the slope upwards should be at least 10 times as much and the use of a higher rate of water flow should be very beneficial.

In this patent the word "helix" is given the meaning of Webster's dictionary where it is defined as a nonplane curve whose tangents are equally inclined to a given plane. A flattened helix is a helix that is flattened on the sides and is substantially like as shown for the flow of the liquids in the drawings of the patent.

I claim:

1. A method for indirectly heating a cold liquid with a hot liquid which comprises passing the cold liquid on one side of a sheet of plastic, said cold liquid touching the sheet, passing the hot liquid on the other side of the sheet, said hot liquid touching the sheet at a spot, said spot being on the opposite side of the sheet from the spot where it was mentioned as being touched by the cold liquid, said plastic sheet being imbedded in a mass of pebbles and being held in place by the mass of pebbles, the direction of flow of the cold liquid and the direction of flow of the hot liquid, when taken over the distance of five times the maximum dimension of the heaviest pebble at the spots mentioned, being at an angle to each other, the directions being measured at the spots mentioned.

2. A method according to claim 1 in which the angle between the direction of flow of the hot liquid and the direction of flow of the cold liquid is between 5° and 175°.

3. A method according to claim 1 in which the angle between the direction of flow of the hot liquid and the direction of flow of the cold liquid is between 25° and 155°.

4. A method according to claim 1 in which the pebbles are made of a crystalline nonmetallic material.

5. A method according to claim 2 in which the pebbles are made of a crystalline nonmetallic material.

6. A method according to claim 3 in which the pebbles are made of a crystalline nonmetallic material.

7. A method according to claim 4 in which the crystalline nonmetallic material is quartz.

8. A method according to claim 5 in which the pebbles are made of quartz.

9. A method according to claim 6 in which the crystalline nonmetallic material is quartz.

10. A method according to claim 4 in which the crystalline nonmetallic material is graphite.

11. A method according to claim 5 in which the crystalline nonmetallic material is graphite.

12. A method according to claim 6 in which the crystalline nonmetallic material is graphite.

13. A method according to claim 4 in which the crystalline nonmetallic material is carbon.

14. A method according to claim 5 in which the crystalline nonmetallic material is carbon.

15. A method according to claim 6 in which the crystalline nonmetallic material is carbon.

16. A method according to claim 1 in which the flow of one of the two liquids is in the form of a flattened helix.

17. A method according to claim 2 in which the flow of one of the two liquids is in the form of a flattened helix.

18. A method according to claim 3 in which the flow of one of the two liquids is in the form of a flattened helix.

19. A method according to claim 4 in which the flow of one of the two liquids is in the form of a flattened helix.

20. A method according to claim 5 in which the flow of one of the two liquids is in the form of a flattened helix.

21. A method according to claim 6 in which the flow of one of the two liquids is in the form of a flattened helix.

22. A method according to claim 7 in which the flow of one of the two liquids is in the form of a flattened helix.

23. A method according to claim 8 in which the flow of one of the two liquids is in the form of a flattened helix.

24. A method according to claim 9 in which the flow of one of the two liquids is in the form of a flattened helix.

25. A method according to claim 1 inn which the flows of both of the liquids are in the forms of flattened helix.

26. A method according to claim 2 in which the flows of both of the two liquids are in the forms of flattened helix.

27. A method according to claim 3 in which the flows of both of the two liquids are in the forms of flattened helix.

* * * * *